US005638653A

United States Patent [19]

Rossi

[11] Patent Number: 5,638,653

[45] Date of Patent: Jun. 17, 1997

[54] SYSTEM FOR FITTING PANELS WITHOUT VISIBLE FIXING MEANS

[75] Inventor: Roland Rossi, Montfermeti, France

[73] Assignee: Societe de Fabrication et de Diffusion, Mitry Mory Cedex, France

[21] Appl. No.: 468,796

[22] Filed: Jun. 6, 1995

[30] Foreign Application Priority Data

Jun. 10, 1994 [FR] France ..... 94 07136

[51] Int. Cl.[6] ..... E04F 13/08; E04B 1/38

[52] U.S. Cl. ..... 52/511; 52/36.6; 52/403.1; 52/764

[58] Field of Search ..... 52/36.6, 403.1, 52/511, 764, 773, 774

[56] References Cited

U.S. PATENT DOCUMENTS 4,304,073 12/1981 Reith ..... 52/36.6 X
4,625,477 12/1986 Johnstonbaugh ..... 52/36.6 X
5,185,971 2/1993 Johnson, Jr. ..... 52/36.6
5,263,292 11/1993 Holland et al. ..... 52/511 X

FOREIGN PATENT DOCUMENTS 0107739 of 0000 European Pat. Off. .
0149770 3/1987 European Pat. Off. .

*Primary Examiner*—Carl D. Friedman
*Assistant Examiner*—Timothy B. Kang
*Attorney, Agent, or Firm*—Baker & Daniels

[57] ABSTRACT

A system for fitting panels without physical affixing means, especially for covering walls and installing shelves and suspended equipment. The system includes a rack having a main branch and at least one side branch and one bearing branch. The main branch and side branch define a housing in which an elastic bearing piece is removably connected. The bearing piece has a cross section corresponding to the cross section of the housing. The height of the bearing piece is chosen depending on the desired level of the front face of the panel with respect to the rack in its mounted position.

6 Claims, 9 Drawing Sheets

SYSTEM FOR FITTING PANELS WITHOUT VISIBLE FIXING MEANS

The present invention relates to a system for fitting panels without visible fixing means, especially for covering walls and installing shelves or suspended equipment, comprising:

racks in the form of sections, fixed to a support such as a wall or a piece of furniture, the rack having holes for fastening consoles or hooks receiving the shelves or the suspended equipment, each rack having an omega-shaped cross-section with a central part provided with fastening holes, this central part being formed by two branches connected by a cross-piece and being bordered by at least one side part comprising a bearing branch and an upturned side branch, the rack being fixed to the support at the bearing branches, the side branches forming a stop for the covering or display panels placed between the racks.

The invention also relates to a tool for installing such a system.

Wall coverings and, especially, equipment for shops increasingly consist of rack systems receiving consoles for supporting display cases or shelves. These racks may also receive hooks for suspending articles to be displayed.

In general, the space between two racks is covered with a panel constituting a background decoration or else, for example, a holed panel, making it possible to receive hooks or display supports.

Depending on the case, the panels are placed between the racks and do not extend beyond them. In other cases, these panels partially fit over the racks, leaving only a slot just sufficient for positioning the consoles or angle brackets supporting the display equipment or shelves.

The panels are placed freely between the sections and are held in place by retaining members or keys which are fastened into the rack and have tabs which extend beyond the front face of the panels in order to retain them.

Such known systems have the drawback of requiring keys for retaining the panels which must remain removable, in order to be able to dismantle them in order for them to be replaced. In addition, even if the panels are not intended to be dismantled, fixing them to the racks using screws would create very significant difficulties and, in addition, from an aesthetic standpoint, there would be places for the screws; it is therefore almost universally chosen to fix them using keys.

Another drawback of the known systems is that of the installation of the racks.

In general, since the precision with which the walls are made is rather crude, it is relatively difficult, and most especially takes a long time, to fix the racks, since all the racks on the same wall must be parallel. Under these conditions, in order to compensate for the irregularities in the support, it is necessary to provide shims at certain locations between the racks and the support. This adjustment work takes a long time since it can only be done progressively, from one rack to another.

Finally, it is necessary not only for the racks to be all located in the same plane but also for them to be parallel. However, this parallelism is difficult to achieve, precisely because the support is irregular.

Since this parallelism is never perfect and as the sections may be fixed with undulations and the intermediate panels out leaving a safety margin, this results in irregular gaps between the sections, or between the edges of two adjacent panels. Now, these gaps are particularly annoying from an aesthetic standpoint, the more so since they may be irregular.

The object of the present invention is to remedy these drawbacks and is intended to create a system for fitting panels without visible fixing means, especially for covering walls and/or installing shelves or suspended or display equipments, which is composed of sections or racks receiving the panels and/or the shelves or equipment by means of consoles, angle brackets or hooks and which is particularly simple to install while at the same time having an impeccable aesthetic appearance, eliminating the irregular joints between the panels or the sections and making it possible to install, particularly simply, not only the panels but also the sections with perfect parallelism with respect to the panels.

For this purpose, the invention relates to a system of the type defined hereinabove, characterized in that it comprises:

bearing pieces fixedly connected to the panels in order to be engaged elastically and removably in the housings formed on the racks between each main branch, the side branch and the bearing branch, these bearing pieces having a cross-section corresponding to that of the housing, the height of the bearing pieces being chosen depending on the desired level for the front face of the panel with respect to the rack.

In the system according to the invention, the panels are mounted simply by pressing them without a visible fixing member and the edges of the panels may thus be precisely adjusted either to the width of the central part of the racks or only to the width necessary for passage of the consoles, the racks themselves then being hidden or else having contiguous panels. This system is made precisely, without it being necessary to provide clearance between the panels and/or the racks, which clearance was necessary in the prior art because of the relative inaccuracy in installing the racks.

The bearing pieces are installed on the panels simply by putting the bearing pieces in the housings in the two racks. Then, after having coated the bearing surface of the pieces with adhesive, the panel is placed between the racks and the assembly is held together for the time necessary for bonding. These bearing pieces make it considerably easier to install the racks. In fact, and by operating in a different way from the known procedures, one panel is firstly fixed to two racks which are themselves not yet fixed to the support (wall). To do this, the bearing pieces are placed in the housings in the racks, the adhesive is applied and the panel pressed against the bearing members placed in the two racks, applying the racks closely against the two edges of the panel. The assembly is clamped for the bonding time. After the adhesive has set, an integral assembly, formed by the panel and the racks along its two edges, is obtained. Being rigid, the panel holds the racks in place, these thus naturally remaining parallel and with an appropriate spacing. The assembly thus formed may be installed on a support such as a wall, even if this support is somewhat irregular. Thus, it is possible to fix the racks by placing the shims at the correct location without, during installation, the racks being deformed by pulling them into the hollows or by making them pass over the bumps.

This installation is much easier than the installation of racks using straightedges and spirit levels in order to make sure that the racks are parallel and straight on the support.

In fact, in the general case, the racks are installed by using the abovementioned principle but by proceeding iteratively from a first rack installed on the support. This first rack then receives a first panel whose edge intended for this rack is provided with bearing pieces and whose other edge carries the bearing pieces which themselves hold the second rack. According to a variant mentioned later, the connection between the rack and the panel may be performed using suitable tools, allowing removable mounting without having to fix the bearing pieces immediately.

Then, this second rack is fixed and the operation repeated, starting from this second rack, in order to install a third rack by using a panel of width suitable for the new spacing.

The invention thus makes it possible to easily produce a system having racks and panels of identical or variable spacings or widths depending on the requirements of the room to be equipped or on the desired aesthetic aspects.

The panels of the system can be easily dismantled, which makes it possible to modify the decoration of the system or to replace smooth panels with, for example, holed panels serving to receive display accessories or other items.

This also allows work to be carried out on completed systems, for example in order to carry out work on the electrical system.

It is easy to gain access to ready cables between the covering and the wall in order to supply lighting for the shelves of a panel. To do this, all that is required is to release one side of the panel, relying on the elasticity of the bearing pieces of the other edge of the panel, operated like a hinge.

After completing the work, the raised side of the panel is fixed again.

Another possibility consists in replacing some of the panels with glass to which the bearing pieces will be fixed.

In general, and contrary to the known systems, the coverings or systems for shelves, display units or other items may be dismantled and reinstalled without damaging the panels.

Another advantage of the invention is to simplify considerably the work on the site and to allow perfect finishing. The reason for this is that, since the spacing of the panels or of the racks is obtained on the basis of the panels, and not the reverse as in the prior art, it is easy to fix the bearing pieces onto the panels so that these are perfectly contiguous between themselves or with the racks, this being so by starting with factory-cut panels requiring no machining. This makes it, a contrario, unnecessary to carry out possible adjustments of the edges of the panel on site, as was necessary with the known techniques, the more so since such work requires a great deal of care in carrying in out in order not to damage the visible face of the panels which, when the coating is fragile, runs the risk of flaking off. On the contrary, since according to the invention the panels are made up in the factory, this work of cutting the panels may be performed with all the precision and care necessary.

According to another characteristic, the main branch and the side branch have teeth and the bearing pieces have notches in positions equivalent to those of the teeth of the main branch and of the side branch.

These teeth are, in the general sense, fastening members which increase the retention of the pieces in the housings. This retention may also be provided by pinching the opening of the housings.

According to another characteristic, the bearing piece is composed of a main part which will go into the housing in the section and of a side part forming, with the main part, a groove which fits over the side branch.

In the case of heavy panels or those intended to be heavily laden, it may be useful to strengthen the retention of the panels by the bearing pieces either by lengthening or increasing the number of the bearing pieces on the racks or by modifying the racks and the bearing pieces, in that each side branch of the rack includes teeth on the external face and the side part of the bearing piece includes notches in a position equivalent to that of the teeth.

According to other characteristics:

the side part is shorter than the main part;

the bearing piece has rounded edges at the front;

the bearing piece is out to length from a profiled strip.

As in any system, there are, according to the invention, special pieces such as sections or racks corresponding to half the cross-section of the usual sections or racks, for example for defects in the covering or for corners.

Likewise, for coverings with panels over large widths, greater than that of one panel, parts of sections are used, these sections being simply limited to the housing receiving the bearing pieces but not appearing at the front of the panels which will then be contiguous.

The invention also relates to a tool for installing panels and racks, this tool being characterized in that it is composed of a plate having a thickness close to that of a console and having at least one notch in order to be fastened into a hole in the rack, this plate carrying a slide-plate which terminates at the front in a bearing surface, this plate carrying a locking screw bearing on the slide-plate in order to press it against the front face of a panel, when the tool is connected via its notch to the rack.

This tool may serve as a "clamp" for holding the panel pressed against the bearing pieces housed in the racks during the bonding time; as a variant, this tool allows the bearing pieces not be adhesively bonded to the panel immediately, while still keeping the racks on the panel in order to install the racks on the support.

According to another advantageous characteristic, the plate includes separating ribs defining a thickness slightly greater than that of a console.

The clamping tool thus produced is useful not only for clamping the panel on a rack but also for positioning the panel with respect to the rack in the case of a rabbeted panel, fitting over the central part of the rack in order to leave, with the adjacent panel, only a joint just allowing passage of the consoles or angle brackets.

The present invention will be described in more detail by means of the appended drawings in which:

FIGS. 1 to 3 show diagrammatically the structure of a system for fastening shelves or suspended equipment according to two known system variants which will be described to two known system variants which will be described hereinbelow with the aide of the figures in order to explain this prior art more clearly.

Figure 1:
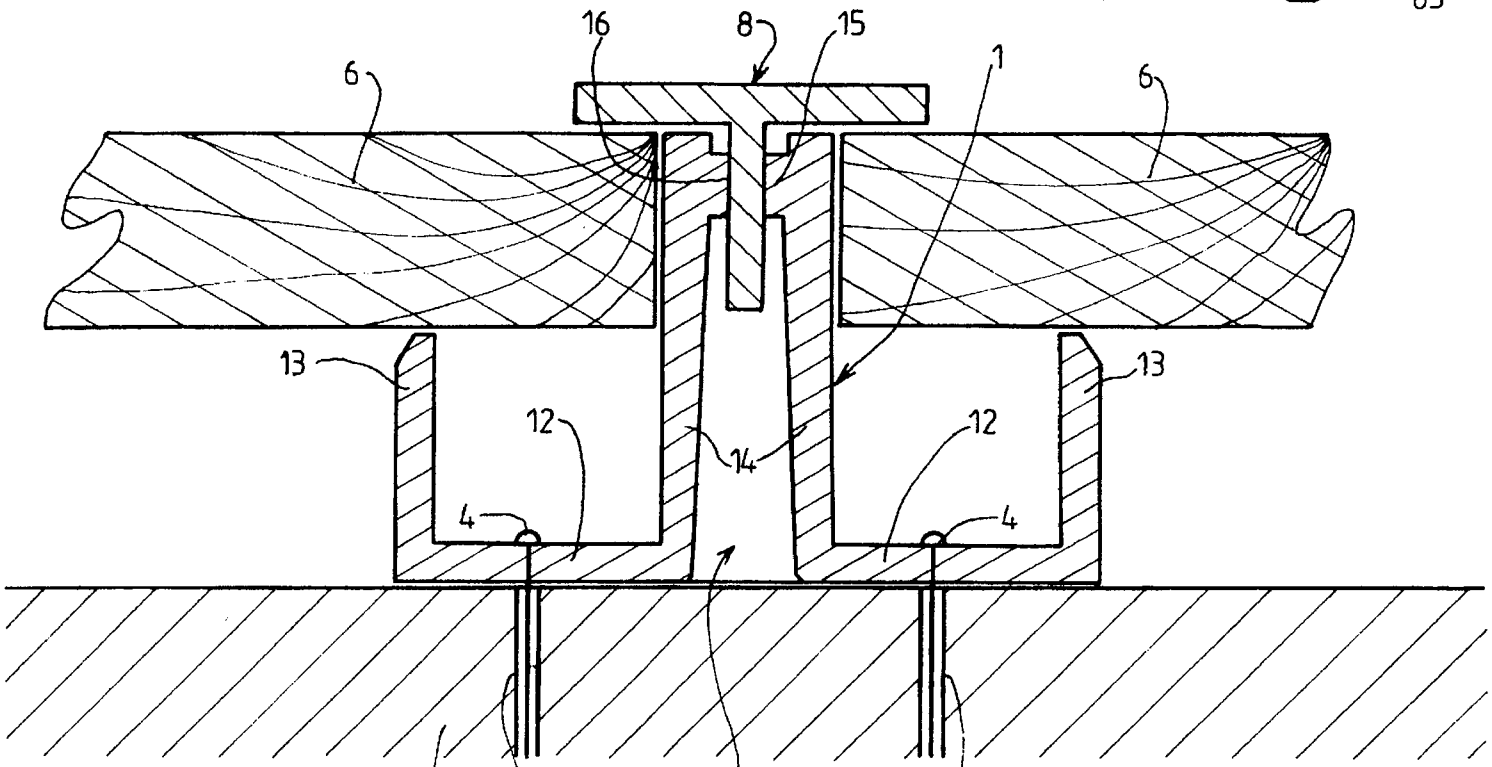
FIG. 1 PRIOR ART
FIG. 1 is a cross-section of a known system, in terms of a rack and two panels joined to the rack.

According to the embodiment of FIG. 1, the system is composed of racks 1 fixed to a support 2, such as a wall, by connection means such as screws 4 with wall plugs 5. These racks 1 are intended to receive covering or supporting panels 6, 7 retained in the rack 1 by fastening pieces in the form of keys 8.

In more detail, the rack 1 is composed of a central part 11 connected by bearing branches 12 to upturned side branches 13. The central part is composed of two main branches 14 connected at the top by a cross-piece 15. This cross-piece 15 is provided with holes 16, in the form of, for example, rectangular holes serving to receive consoles carrying the shelves or other display units, as well as the keys 8 retaining the panels 6.

The bearing branches 12 which border each side of the central part 11 are connected to the main branches 14 and include drillholes for the passage of fixing screws 4. These bearing branches terminate in upturned side branches 13 serving as a support for the panels 6.

Figure 2:
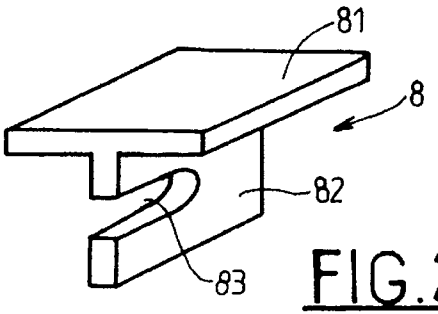
FIG. 2 PRIOR ART
FIG. 2 is a perspective view of a known panel-fixing key.

The key 8 (FIG. 2) retaining the panels 6 is composed of a plate 81, which goes in front of the panels 6, and of a perpendicular branch 82 provided with a cutout 83 for fastening into the drillholes 16 in the central part 11 of the rack 1.

Figure 3:
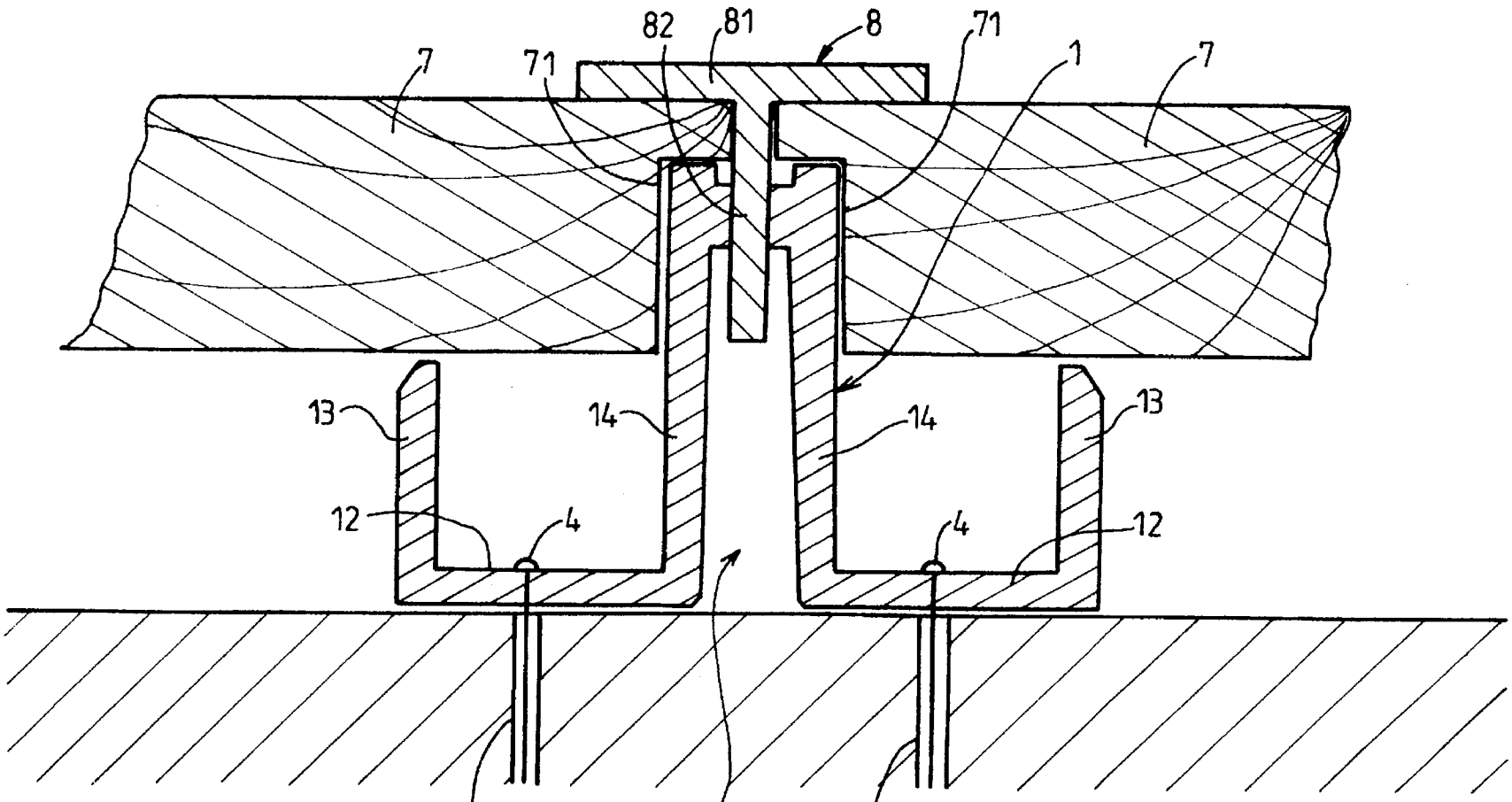
FIG. 3 PRIOR ART
FIG. 3 is a sectional view similar to that of FIG. 1, showing another way of installing panels on known racks.

The known variant of FIG. 3 is distinguished from that of FIG. 1 in that the panels 7 include a rabbet 71 which allows the panels to fit over the front end of the central part 11, the facing edges of the panels 7 leaving only a gap which corresponds substantially to the thickness of the branch 82 of the key and which also corresponds to the thickness of the consoles or angle brackets.

Moreover, it should be pointed out that the key 8 of the example in FIG. 3 has a notch 83 placed so as to take account of the additional thickness of the panels 7 with respect to the front face of the central part 11 of the rack 1.

Figure 4:
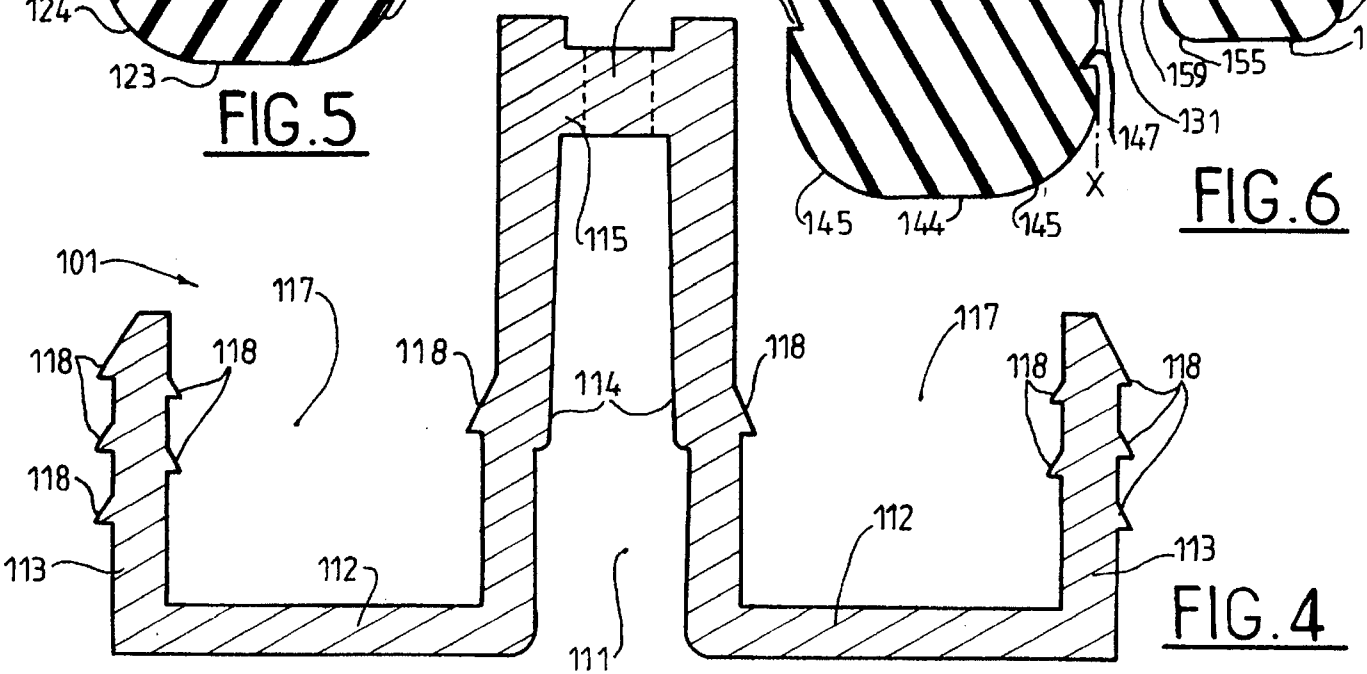
FIG. 4 is a sectional view of a rack according to the invention.

The system for fitting panels without visible fixing means, especially for covering walls and/or installing shelves or suspended equipment, and tool for installing such a system of shelves or of suspended equipment, according to the present invention, as shown in FIGS. 4 to 8, is also composed of omega-shaped racks 101 fixed to a support 102, an example of which is shown in cross-section in FIG. 4. These racks comprise a central part 111 formed by two main branches 114 and by a cross-piece 115 provided with holes 116 receiving the consoles or angle brackets. The main part is bordered by side parts also formed by bearing branches 112 and terminated in upturned branches 113.

Figure 6:
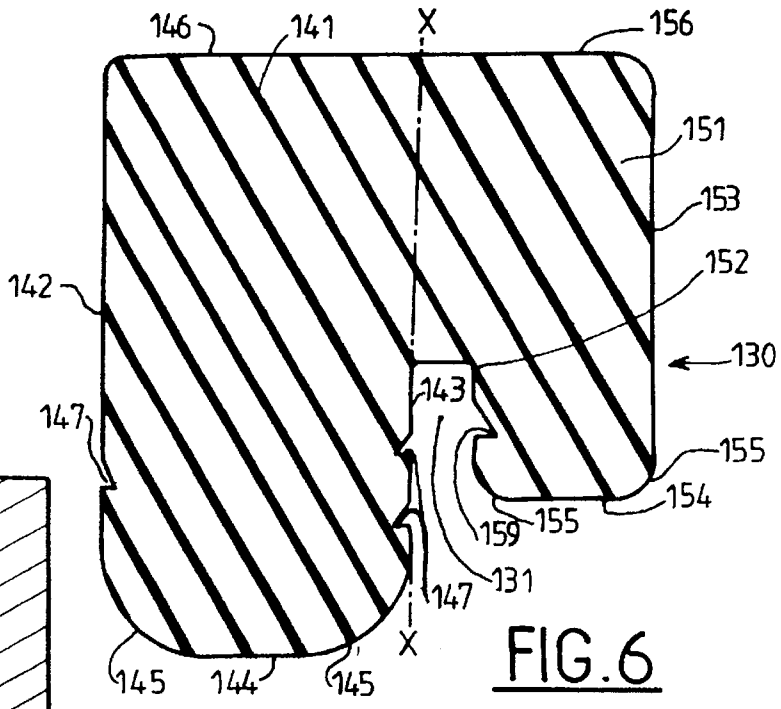
FIG. 6 is a sectional view of another bearing piece according to the invention.
Figure 5:
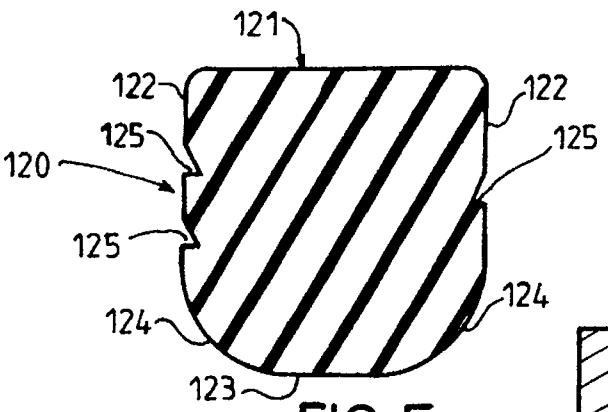
FIG. 5 is a sectional view of a first embodiment of bearing pieces according to the invention.

In each case, a main branch 114, the corresponding bearing branch 112 and the corresponding side branch 113 define a housing 117 intended to receive a bearing member 120 or 130 (FIGS. 5, 6). In the example of FIG. 4, the main branch 114 includes a tooth 118 and the side branch 113 includes two teeth 118 facing inwards. This branch also includes three teeth 118 on the outside, for reasons which will appear later.

According to a first embodiment, the bearing piece 120 (FIG. 5) is a portion of a material having a certain elasticity, corresponding, for example, to a 70 Shore hardness, and cut from a strip or a bar of such a material.

This bearing piece has a rectangular cross-section with a bearing face 121, two side faces 122 and a bottom 123 connected to the side faces by rounded parts 124. Finally, on the sides 122 there are notches 125 in positions equivalent to the teeth 118 of the housings 117.

Figure 7:
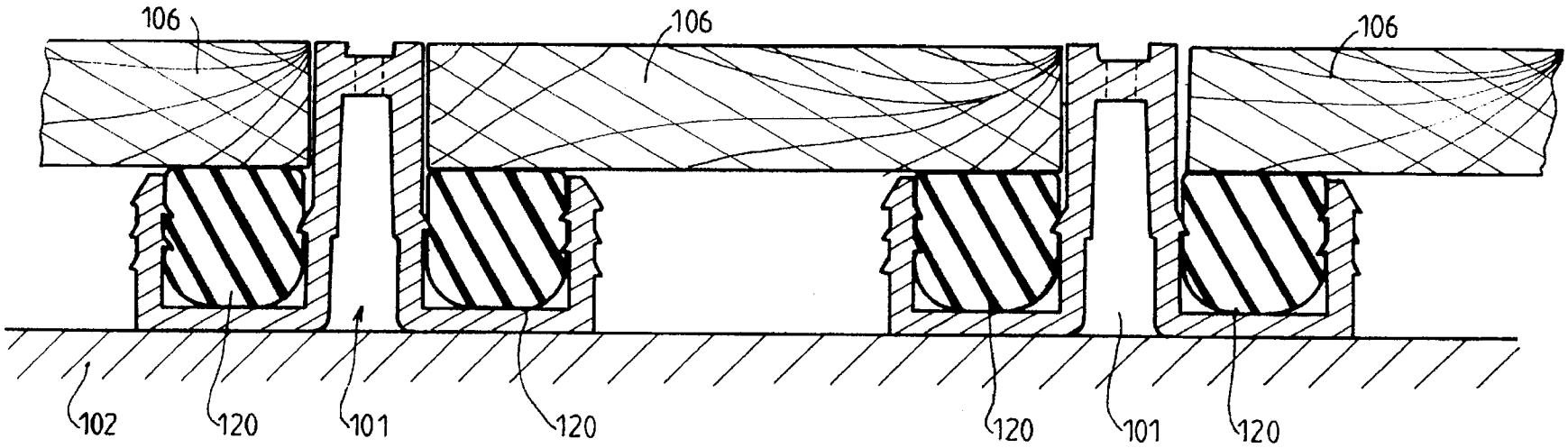
FIG. 7 is a cross-sectional view of a system according to the invention, showing racks and panels fixed to the racks.
Figure 8:
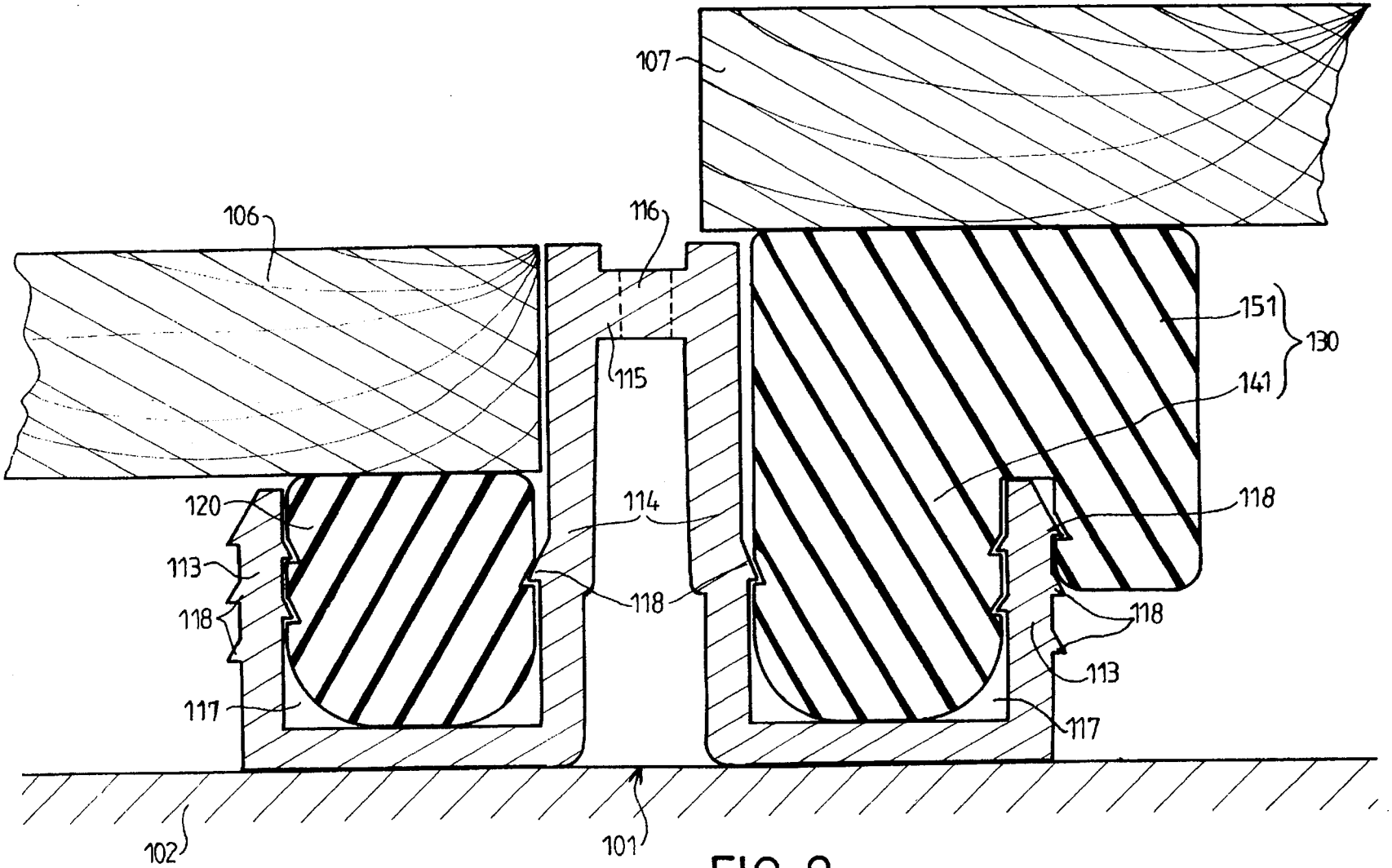
FIG. 8 shows, on a different scale from FIG. 7, two possible ways of installing panels on a rack.

This bearing piece 120 is placed in the housing 117, as may be seen in FIGS. 7 and 8.

The bearing surface 121 is intended to be adhesively bonded to the back of a panel 106 or 107 (FIGS. 7 and 8).

FIG. 6 shows the cross-section of another embodiment of a bearing piece 130 formed by a main part 141 and a side part 151, these parts being joined along the plane XX. In fact, the main part 141 corresponds to the cross-section of the piece 120, but extended in the height direction. A groove 131 is formed between the two parts 141, 151.

The bearing piece 130 has, for its main part 141, a shape similar to that of the bearing piece 120—its side faces 142, 143 are flat, like its front face 144, with rounded parts 145 at the join.

In the example shown, this part 141 has a height substantially equal to that of the main branch 114 of the rack so that its bearing face 146 is level with the front face of the branches 114 of the rack and to allow the panels 107 to be installed as shown in FIG. 8.

However, it is also possible for the height of the part 141 to be smaller, depending on the panel thickness and on the difference in height between the branches 114 and 113. The side faces 142, 143 are provided with notches 147 in positions equivalent to the teeth 118 of the branches 114, 113.

The side part 151 has plane side faces 152, 153, a front face 154 joined to the side faces by rounded parts 155 and a bearing face 156 in alignment with the face 146. The face 152 is provided with a notch 159.

The side part 151 has a smaller height than that of the main part 141.

Like the piece 120, the piece 130 is placed in the bottom of the housing 117, bearing by its face 144 against the bearing branch 112 so as to define precisely the level of the bearing surface (146, 156) and consequently the level of the panel.

This piece 130 is installed, for the main part 141, like the piece 120, the side part 151 overlapping with the groove 131 the side branch 113.

FIG. 7 is a cross-section showing the installation of panels 106 on racks 101 fixed to a support 102 such as a wall. In this example, the panels leave the racks 101 accessible to the consoles or hooks, which are not shown, the panels using the bearing pieces 120.

Figure 7A:
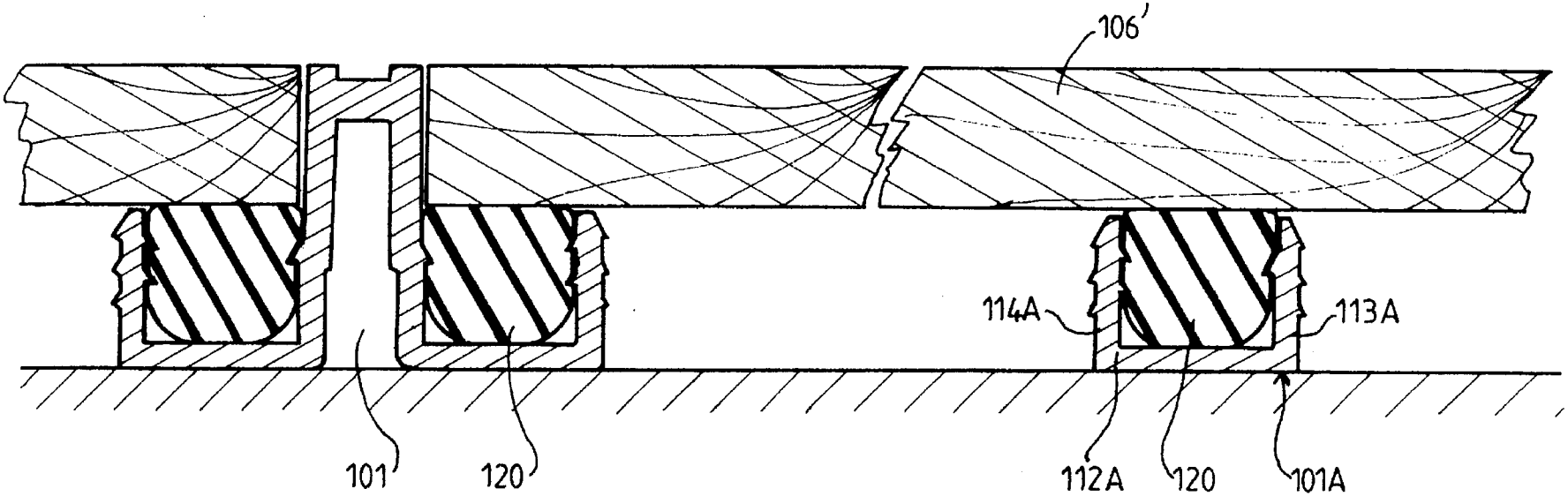
FIGS. 7A and 7B show two variants, the first one for a panel of large width and the second one for joining two panels edge to edge.

FIG. 7A shows a variant for panels 106' having a relatively large width between the racks 101 and requiring the panel 106' to be supported in order to achieve perfect planarity. To do this, a section 101A is used, the cross-section of which corresponds to part of the cross-section of the section 101 for receiving the bearing pieces 120. This section is composed of the branch 113, (113A), of the bearing branch 112A corresponding to the branch 112 and of the branch 114A corresponding to part of the main branch 114.

Figure 7B:
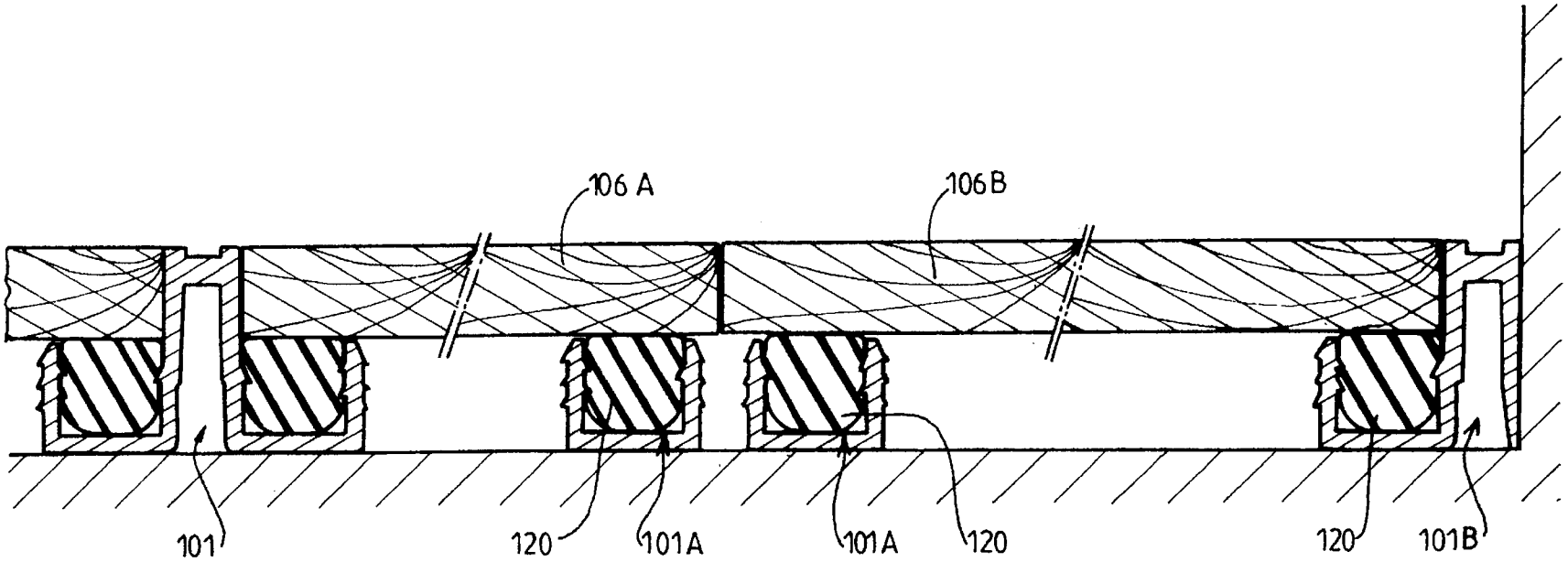

The variant according to FIG. 7B corresponds to the edge-to-edge assembly of two panels 106A, 106B with bearing on a section 101A, as in FIG. 7A, with bearing pieces 120. This figure also shows another special piece, for a corner—a part 101B of the section 101 having kept the cross-piece with the holes forming the rack.

FIG. 8 shows the two cases of installing the panels 106 and 107 using bearing pieces 120 or 130 depending on whether it is desired to leave the entire front face of the central part 111 visible or only a slot for installing the consoles.

Figure 9:
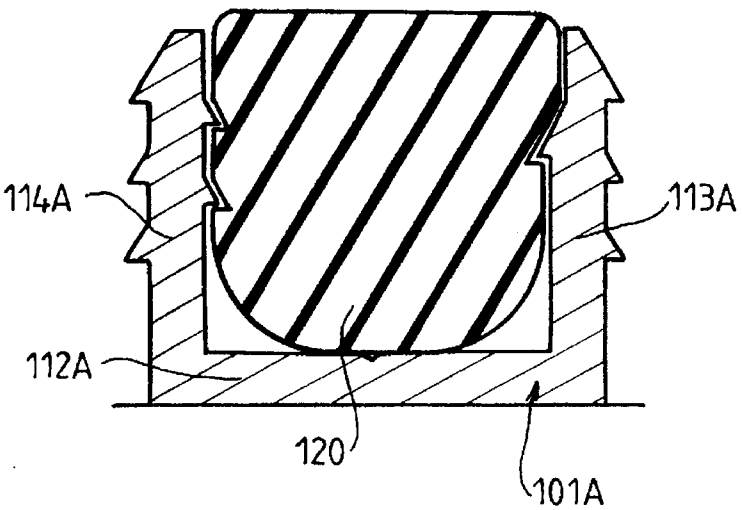
FIG. 9 is a sectional view of an intermediate low section.

FIG. 9 shows the cross-section of a section 101A, as described hereinabove, with a bearing piece 120.

Figure 10:
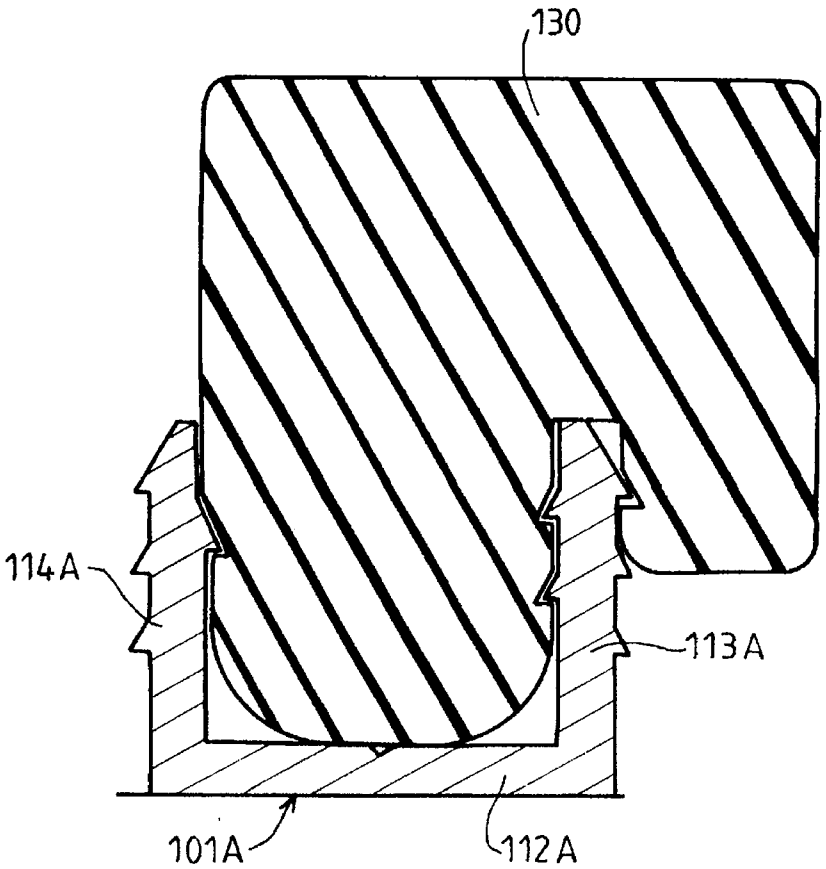
FIG. 10 is a sectional view of a tall section for a grooved bearing piece according to FIG. 6.

FIG. 10 shows a section 101A receiving a bearing piece 130.

Figure 11:
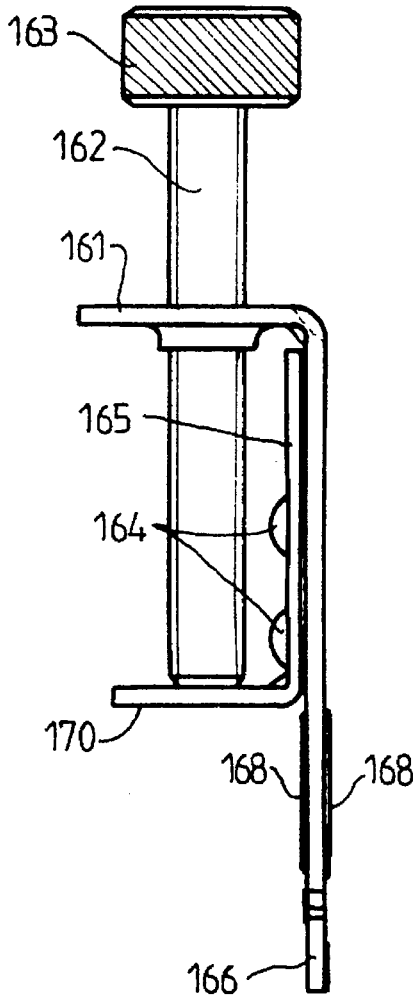
FIG. 11 is a side view of a tool for installing a system according to the invention.
Figure 12:
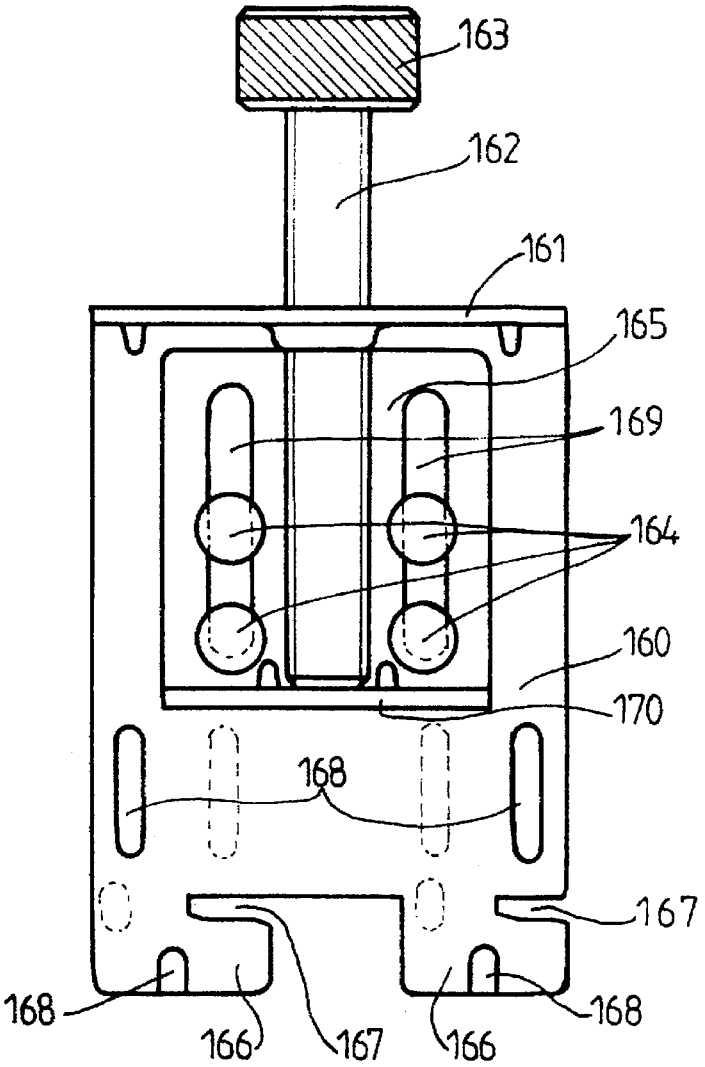
FIG. 12 is a front view of the tool of FIG. 11.

FIGS. 11 and 12 show a clamping tool for holding the panels in place during the bonding of the bearing pieces. This tool is composed of a plate 160 having a thickness close to or less than that of a console. This plate 160 is bent over at right-angles at the top part 161 in order to receive a clamping screw 162 provided with a head 163. This plate 160 includes, in the middle of it, guide heads 164 for the slide-plate 165 and, in the bottom part, tabs 166 defining notches 167 for fastening this tool into the holes in the rack. The plate 160 also includes separating ribs 168 which give the plate the thickness that is desired to be left between two installed that is desired to be left between two installed panels 107, as may be seen in the right-hand part of FIG. 8.

The slide-plate 165 is provided with longitudinal slots 169 for guiding it over the shanks of the guide heads 164. The slide-plate 165 has a bent-over lower part 170 forming a bearing surface. By means of this surface 170, the tool bears on the front of the panel to be clamped.

Depending on the nature of the system, the panels, bearing pieces and racks are installed either by firstly placing the racks in position and then by putting the bearing pieces into the housings in the racks, by adhesively bonding them and by arranging the panels on the bearing surfaces of the pieces, and by holding the assembly clamped, for example using a tool like the one in FIGS. 11 and 12. In the second case, the panel is used as a rack-mounting template in order to make sure that the racks are precisely aligned in difficult cases (irregular supports) or when the panels must be perfectly aligned with the edges of the central parts of the racks. In this case, the assembly, formed by a panel of which one edge is provided with bearing pieces and the other edge of which is provided with bearing pieces which themselves carry a rack, is installed. The free bearing pieces are inserted into the rack already installed and the panel is pressed against the wall. The rack may then be fixed by means of screws which are placed in the holes in the second housing in the rack (that is to say the housing which does not receive the bearing pieces fixed to the panel). Next, the panel is removed and the rail is fixed with screws placed in the housing in the rack previously hidden by the edge of the panel. The operation is continued in this manner, proceeding iteratively, referring each time to an already installed rack in order to position the next rack, respecting the spacings precisely thanks to the template-forming panel.

What is claimed is:

1. A system for fitting panels without visible fixing means comprising:

a plurality of racks for supporting a wall or a piece of furniture, each said rack having a hole for receiving a fastening means, each said rack having an omega-shaped cross-section and including two main branches and a central part defined by said two main branches, said two main branches connected by a cross-piece, one said main branch connected to a side part comprising a bearing branch and an upturned side branch, one of said main branches, bearing branches, and side branch defining a housing, said rack adapted to be secured to a support at said bearing branch, said side branch forming a stop for panels to be placed between said racks, a bearing piece adapted to be fixedly connected to a said panel and removably secured in said housing, one of said main branches and said side branch each having a tooth thereon, said bearing piece having notches for receiving said teeth therein, said notches corresponding in shape to said teeth;

said bearing piece having a cross-section corresponding to that of said housing, the height of said bearing piece selected depending on the desired level for a front face of a said panel with respect to said rack.

2. A system according to claim 1 wherein said bearing piece includes a main part for insertion into said housing and a side part which defines a groove with said main part, said groove mating with said side branch.

3. A system according to claim 2 wherein said side branch includes a tooth on an external face thereof and wherein the side part includes a notch to mate with said tooth.

4. A system according to claim 2, wherein the side part is lower than the main part.

5. A system according to claim 1, wherein the bearing piece has rounded edges at a front face thereof.

6. A system according to claim 1, wherein the bearing piece is cut to length from a profiled strip.

* * * * *